US008468863B2

(12) United States Patent
Menn

(10) Patent No.: US 8,468,863 B2
(45) Date of Patent: Jun. 25, 2013

(54) PROFILE-ROLLING MACHINE

(75) Inventor: Ernst Walter Menn, Hilchenbach (DE)

(73) Assignee: E.W. Menn GmbH & Co. KG, Hilchenbach (DE)

( * ) Notice: Subject to any disclaimer, the term of this patent is extended or adjusted under 35 U.S.C. 154(b) by 555 days.

(21) Appl. No.: 12/667,530

(22) PCT Filed: Aug. 5, 2008

(86) PCT No.: PCT/EP2008/006423

§ 371 (c)(1),
(2), (4) Date: Jan. 2, 2010

(87) PCT Pub. No.: WO2009/018992

PCT Pub. Date: Feb. 12, 2009

(65) Prior Publication Data

US 2010/0175451 A1 Jul. 15, 2010

(30) Foreign Application Priority Data

Aug. 7, 2007 (DE) ..... 10 2007 037 152

(51) Int. Cl.
*B21B 17/04* (2006.01)

(52) U.S. Cl.
USPC ..... 72/90; 72/342.2; 470/185

(58) Field of Classification Search
USPC ..... 72/88, 89, 90, 342.2, 342.5, 342.6, 72/462, 41, 43; 470/183, 185
See application file for complete search history.

(56) References Cited

U.S. PATENT DOCUMENTS

| | | | | | |
|---|---|---|---|---|---|
| 3,214,951 | A | * | 11/1965 | McCardell | 72/88 |
| 3,566,652 | A | * | 3/1971 | McCardell | 72/88 |
| 4,028,921 | A | | 6/1977 | Blue | 72/88 |
| 4,519,231 | A | * | 5/1985 | Roth | 72/88 |
| 5,131,250 | A | | 7/1992 | Smith et al. | 72/90 |
| 5,301,929 | A | | 4/1994 | Pflanz et al. | 266/252 |
| 5,538,558 | A | * | 7/1996 | Ookouchi et al. | 118/423 |
| 5,560,238 | A | * | 10/1996 | Allebach et al. | 72/13.4 |
| 6,108,909 | A | * | 8/2000 | Cheever et al. | 29/898.02 |
| 6,135,437 | A | | 10/2000 | Maass et al. | 271/5 |
| 6,301,945 | B1 | * | 10/2001 | Roseliep | 72/88 |
| 7,021,114 | B2 | * | 4/2006 | Perreault | 72/402 |
| 7,353,679 | B2 | | 4/2008 | Kreissig et al. | 72/88 |
| 7,526,937 | B2 | * | 5/2009 | Zauhar | 72/347 |

FOREIGN PATENT DOCUMENTS

| | | | |
|---|---|---|---|
| DE | 19728669 | | 2/1998 |
| GB | 1070160 | | 5/1967 |
| GB | 210888 | | 5/1983 |
| JP | 59-47035 | * | 3/1984 |
| JP | 60-99407 | * | 6/1985 |
| JP | 63-9515 | * | 1/1988 |

* cited by examiner

*Primary Examiner* — Edward Tolan
(74) *Attorney, Agent, or Firm* — Andrew Wilford

(57) ABSTRACT

The invention relates to a profile-rolling machine for rolling a profile in a blank, wherein the profile-rolling machine has a first and a second profile-rolling jaw. The second profile-rolling jaw (126) is guided—held by a carriage (124)—in a guide track (130) relative to the first profile-rolling jaw (110) for the purpose of rolling the profile into the blank. The carriage (124) has a carriage slide plate (122) and the guide track (130) has a guide slide plate (132). The two slide plates together form a sliding pairing and slide on each other. In order to render said sliding pairing less susceptible to dirty lubricant and less susceptible to wear, it is proposed according to the invention to manufacture the guide slide plate (132) and/or the carriage slide plate (122) at least partially from ceramic or from a non-metallic material or to coat the same with such materials.

6 Claims, 1 Drawing Sheet

PROFILE-ROLLING MACHINE

CROSS REFERENCE TO RELATED APPLICATIONS

This application is the US-national stage of PCT application PCT/EP2008/006423, filed 5 Aug. 2008, published 12 Feb. 2009 as WO2009/018992, and claiming the priority of German patent application 102007037152.9 itself filed 7 Aug. 2007.

FIELD OF THE INVENTION

The invention relates to a profile-rolling machine for rolling a profile, particularly a thread, into a blank.

BACKGROUND OF THE INVENTION

Such profile-rolling machines are known, for example, from the German utility model DE 8124426 [GB 2,108,881]. The profile-rolling machine disclosed there has first and second profile-rolling jaws that be moved toward and away from each other in order to roll the profile into the blank.

Known further developments of such profile-rolling machines have a guide track in which a carriage having the second profile-rolling jaw is guided and can be moved back and forth in order to roll the profile into the blank. In this connection, the carriage as well as the guide track are made with their own slide plates, hereinafter called carriage slide plates and track slide plates, that together form a pair of slides. In the method with a carriage having the second profile-rolling jaw in the guide track, the carriage slide plates and the track slide plates slide on one another, typically with a lubricant between them.

The lubricant between the pair of slides prevents seizing when the carriage moves in the guide.

The problem with the pair of slides that are currently in use, typically special bronze carriage slide plates and nitrided track slide plates, lies in the fact that in the case of such a pair of slides, sliding functions well only with a pure lubricant, and is relatively sensitive to the penetration of dirt. This has the disadvantage that the lubricants used must be collected, purified, and returned in a closed system, which is very complicated and expensive, or are lost in an open system.

OBJECT OF THE INVENTION

Proceeding from this state of the art, the object of the invention is to develop a known profile-rolling machine and, in particular, its pair of slides between carriage and guide track further, such that it becomes significantly less sensitive with regard to its wear and with regard to lubricant behavior than previously known profile-rolling machines.

SUMMARY OF THE INVENTION

This object is attained in a profile-rolling machine according to the invention characterized in that the track slide plates and/or carriage slide plates are produced, at least in part, from ceramic or a non-metallic material, or are coated with it.

By means of the use of these materials for the track slide plates and/or the carriage slide plates, the result advantageously achieved is that the pair of slides formed in this way is both significantly less susceptible to wear and also significantly less sensitive with regard to its lubrication behavior. In particular, use of these materials also permits the use of a closed lubricant system in which lubricants can be used again and again. This saves costs and protects the environment. Furthermore, the profile-rolling machine made according to the invention is less sensitive to the entry of dirt because of the great hardness of the materials. Finally, it should be pointed out that the pair of slides made according to the invention also allows the use of a combined coolant and lubricant medium, i.e. a medium that fulfills both cools and lubricates. The use of such a combined medium has the advantage that it is not necessary to provide both a coolant circuit and a lubricant circuit, but rather only one circuit is required, thereby again making it possible to save costs.

According to a first illustrated embodiment, costs can be cut if the track slide plates and/or the carriage slide plates are not formed entirely of ceramic, but rather only with one or more inserts or a coating of ceramic.

It is advantageous if the second profile-rolling jaw is attached to the carriage as a wear part, in replaceable manner.

If the carriage is guided along the guide track in a dovetail groove or a guide similar to a T-groove, this has the advantage that the carriage and thus also the second profile-rolling jaw are guided in stabilized manner during the back and forth movement, even transverse to the guide track.

To implement the relative movement between the first profile-rolling jaw and the second profile-rolling jaw, for rolling the profile into the blank, both profile-rolling jaws can basically be moved. However, it is completely sufficient to fixedly mount the first profile-rolling jaw and/or the guide track, preferably on the profile-rolling machine.

The use of a lubricant between the pair of slides advantageously reduces the friction resistance between it. If necessary, however, the pair of slides can also be used without special lubricants, particularly when using ceramic.

BRIEF DESCRIPTION OF THE DRAWING

Other advantageous embodiments are the object of the dependent claims. In the attached two figures that refer to the specification:

DETAILED DESCRIPTION

The invention will be described in detail below with reference to the described figures and to an illustrated embodiment.

Figure 1:
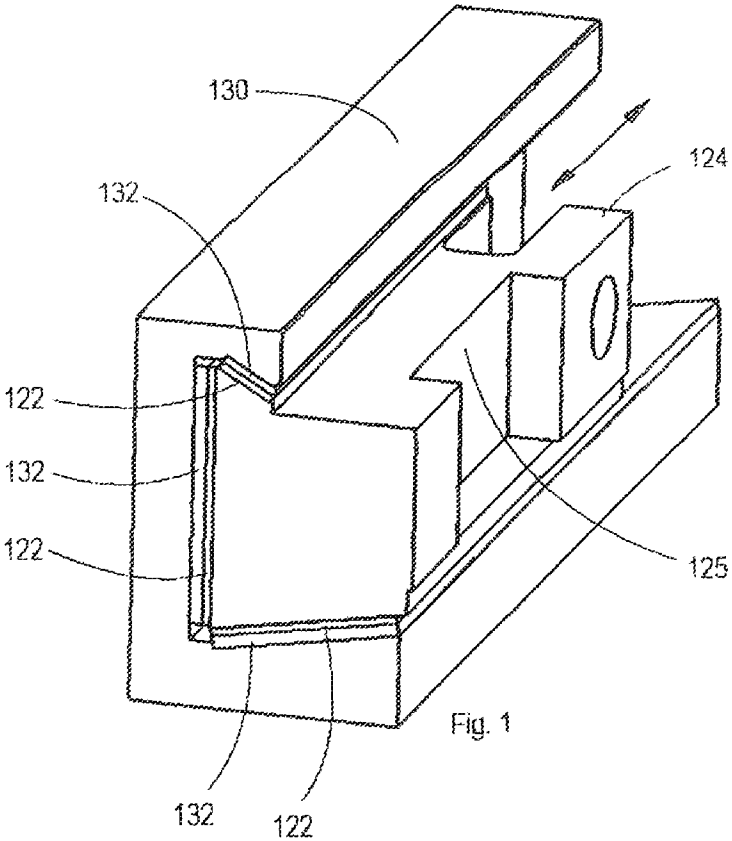
FIG. 1 shows a perspective view of a guide track according to the invention, with a carriage according to the invention.

FIG. 1 shows a guide track 130 according to the invention in which a carriage 124 is mounted so that it can move back and forth. The back and forth movement takes place in the direction of the double-headed arrow. The carriage 124 has a seat 125 into which a second replaceable profile-rolling jaw 126 can be releasably secured. The guide track 130 has track slide plates 132 that are preferably of large area and form a pair of slides together with carriage slide plates 122 on the carriage 124. According to the invention, the track slide plates 132 and/or the carriage slide plates 122 are at least partially made from or coated with a ceramic or a non-metallic material. The advantages that result have been described above.

Figure 2:
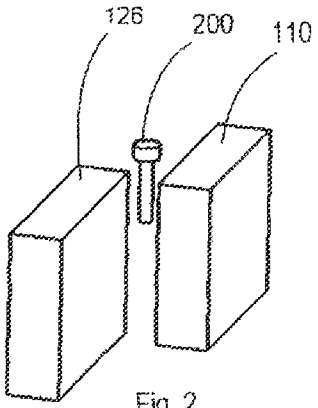
FIG. 2 shows the first and the second profile-rolling jaws.

FIG. 2 shows the functional principle of the profile-rolling machine, where a first profile-rolling jaw 110 and the second profile-rolling jaw 126 are moved back and forth, relative to one another, in order to roll a profile, particularly a thread, into a blank 200 between them.

The invention claimed is:

1. A profile-rolling machine for rolling a profile into a blank, the profile-rolling machine comprising:

a first profile-rolling jaw;

a second profile-rolling jaw;

a carriage for holding the second profile-rolling jaw and having at least one carriage slide plate;

a guide track having at least one track slide plate on which the carriage rides with its carriage slide plate such that the second profile-rolling jaw can move toward and away from the first profile-rolling jaw to roll the profile into the blank, the track slide plate or the carriage slide plate being provided with individual longitudinally extending insert strips of ceramic;

a closed system extending between the carriage slide plate and the track slide plate; and means for circulating a combined coolant and lubricant through the closed system and thereby between the carriage slide plate and the track slide plate.

2. The profile-rolling machine according to claim 1, wherein the second profile-rolling jaw is replaceably attached to the carriage.

3. The profile-rolling machine according to claim 1, wherein the guide track is formed with a dovetail groove and the carriage guided in it is of dovetail section.

4. The profile-rolling machine according to claim 1, wherein the first profile-rolling jaw or the guide track is mounted stationarily on the profile-rolling machine.

5. The profile-rolling machine according to claim 1, wherein the carriage, the carriage slide plate, and the second profile-rolling jaw are made at least partially in one piece.

6. The profile-rolling machine according to claim 1, wherein the guide track and the track slide plate are made in one piece.

* * * * *